US008418780B2

(12) United States Patent
Lau et al.

(10) Patent No.: US 8,418,780 B2
(45) Date of Patent: Apr. 16, 2013

(54) POWER TOOL

(75) Inventors: James Ching Sik Lau, Hong Kong (CN); Yuen Tung Louie, Hong Kong (CN)

(73) Assignee: Johnson Electric S.A., La Chaux-de-Fonds (CH)

( * ) Notice: Subject to any disclaimer, the term of this patent is extended or adjusted under 35 U.S.C. 154(b) by 508 days.

(21) Appl. No.: 12/328,326

(22) Filed: Dec. 4, 2008

(65) Prior Publication Data

US 2009/0145621 A1 Jun. 11, 2009

(30) Foreign Application Priority Data

Dec. 7, 2007 (GB) ..... 0723914.8

(51) Int. Cl.
*B25D 17/00* (2006.01)

(52) U.S. Cl.
USPC ..... 173/171; 173/217; 310/50

(58) Field of Classification Search ..... 173/171, 173/217; 310/60 R, 64; 429/61, 71, 120
See application file for complete search history.

(56) References Cited

U.S. PATENT DOCUMENTS

| | | | | |
|---|---|---|---|---|
| 2,554,236 | A * | 5/1951 | Bernard | 219/75 |
| 5,006,740 | A | 4/1991 | Palm | |
| 6,455,186 | B1 * | 9/2002 | Moores et al. | 429/71 |
| 6,543,549 | B1 | 4/2003 | Riedl et al. | |
| 2004/0124721 | A1 | 7/2004 | Pfisterer | |
| 2004/0192181 | A1 | 9/2004 | Bohne et al. | |
| 2004/0226969 | A1 | 11/2004 | Shew | |
| 2005/0202310 | A1 * | 9/2005 | Yahnker et al. | 429/62 |
| 2007/0236177 | A1 * | 10/2007 | Phillips et al. | 320/115 |
| 2009/0245958 | A1 * | 10/2009 | Lau et al. | 408/125 |

FOREIGN PATENT DOCUMENTS

| | | | |
|---|---|---|---|
| DE | 19924552 | A1 | 11/2000 |
| WO | WO-2005/110251 | A2 | 11/2005 |

* cited by examiner

*Primary Examiner* — M. Alexandra Elve
*Assistant Examiner* — Nathaniel Chukwurah
(74) *Attorney, Agent, or Firm* — Muncy, Geissler, Olds & Lowe, PLLC

(57) ABSTRACT

A power tool having a cooling system, comprises: a motor housing 11 having a main chamber 14 accommodating a tool motor 12; a handle 15 for holding the power tool and having a cooling passage 16 for the transfer of cooling fluid, at least one inlet 18 leading to the cooling passage and at least one outlet 13 leading away from the cooling passage 18 , and a power tool component 21 which generates heat disposed in thermal contact with the cooling passage 16 between the inlet 18 and the outlet 13.

17 Claims, 5 Drawing Sheets

POWER TOOL

CROSS REFERENCE TO RELATED APPLICATIONS

This non-provisional patent application claims priority under 35 U.S.C. §119(a) from Patent Application No. 0723914.8, filed in Great Britain on Dec. 7, 2007.

FIELD OF THE INVENTION

The present invention relates to cooling systems for power tools and in particular is relevant to cordless power tools.

BACKGROUND OF THE INVENTION

A cordless power tool such as a drill is typically constructed with working components such as a motor and drill shaft being located in an upper generally cylindrical casing. A handle extends from below the cylindrical casing and is typically provided with a battery pack at its bottom end. Wiring from the battery pack typically extends up through the handle to electrical circuitry located either in the handle or the motor compartment.

U.S. Pat. No. 6,455,186 describes a battery cooling system for a cordless power drill in which air is drawn into intake openings in the main casing through a passage in the handle through passages in the battery casing and out through openings in the battery casing. A fan is located in the handle or battery casing to provide circulation of air over the batteries.

The present invention provides an alternative type of cooling system for a power tool.

According to a preferred embodiment of the invention a cooling system in accordance with the present invention provides improved cooling of heat generating components of the power tool.

SUMMARY OF THE INVENTION

Accordingly, in one aspect thereof, the present invention provides a power tool having a cooling system, comprising: a motor housing having a main chamber, a tool motor accommodated within the main chamber, a handle for holding the power tool, the handle having a cooling passage for the transfer of cooling fluid, an inlet leading to the cooling passage and an outlet leading away from the cooling passage, and a power tool component which generates heat, disposed in the handle, in thermal contact with the cooling passage between the inlet and the outlet.

Preferably, the power tool further includes a flow induction device for inducing flow of cooling fluid from the inlet to the outlet.

Preferably, the flow induction device is located at least partially in the main chamber of the cooling passage.

Preferably, the flow induction device comprises one or more fans.

Preferably, the flow induction device is a fan driven by the power tool motor.

Preferably, the power tool component is a speed control circuitry.

Preferably, a heat sink for the speed control circuitry is located at least partially in the cooling passage.

Optionally, the flow induction device is a fan mounted on the heat sink.

Preferably, a battery casing is provided, having one or more of said inlets and accommodating a number of batteries, and the handle extends between the main chamber and the battery casing.

Preferably, the cooling passage comprises a cooling conduit of high heat transfer material and wherein a heat sink of the power tool component is directly attached to the cooling conduit.

Alternatively, a heat pipe is disposed in the cooling passage, the heat pipe being in direct contact with a heat sink of the power tool component.

Alternatively, the cooling passage comprises a rubber tube and further includes a heat transfer box connected to the rubber tube and at least partially housing a cooling portion of the power tool component.

Preferably, the cooling portion of the power tool component comprises fins of a heat sink.

According to a second aspect, the present invention provides a power tool having a cooling system, comprising: a motor housing having a main chamber, a tool motor accommodated within the main chamber, a handle for holding the power tool, a heat pipe accommodated in the handle, and a power tool component which generates heat, disposed in the handle, wherein the power tool component is in thermal contact with the heat pipe.

Preferably, the heat pipe is cooled by a flow of cooling air within the main chamber.

Preferably, the heat pipe makes thermal contact with a heat sink of a battery attached to the handle Preferably, the flow induction device may have a dedicated source of power.

BRIEF DESCRIPTION OF THE DRAWINGS

Preferred embodiments of the present invention will now be described, by way of example only, with reference to the accompanying drawings in which.

DETAILED DESCRIPTION OF THE DRAWINGS

Figure 1:
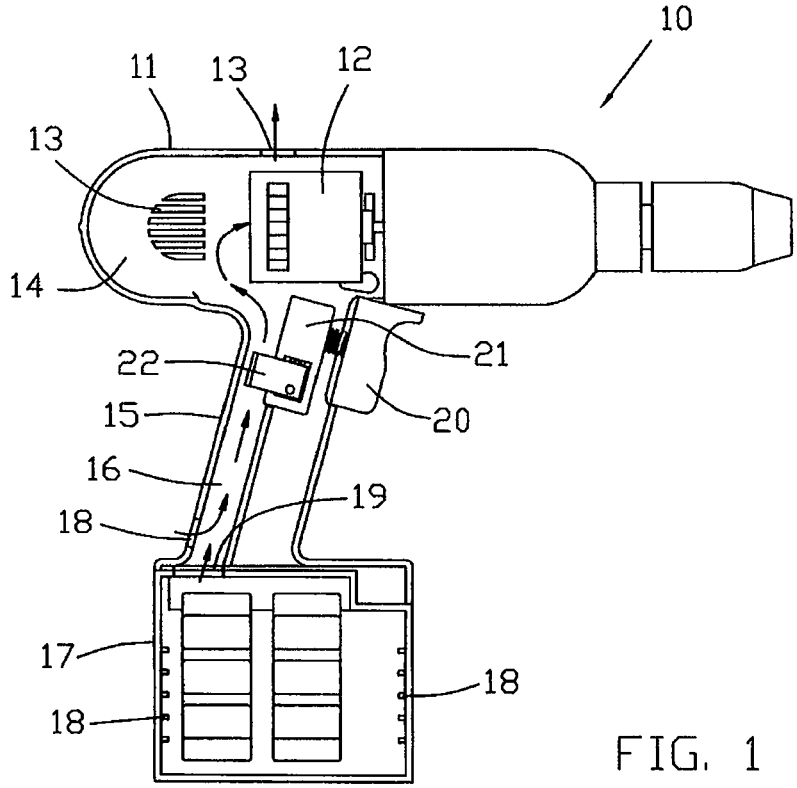
FIG. 1 shows a cordless power tool with a cooling system according to a first embodiment of the present invention.

FIG. 1 shows a cordless power tool 10 in the form of a drill consisting of a motor housing 11 having a main chamber 14 in which is located a motor 12 and gear box (not shown).

A number of horizontal ventilation slots 13 are provided in a vertical column on each side of the housing 11 in order to provide ventilation for the chamber 14. These ventilation slots 13 are located behind the motor 12 and may serve as air inlets and/or outlets. Additional ventilation slots 13 may be provided adjacent the motor 12.

A handle 15 extends below the housing 11 and includes a passage 16 which extends from the chamber 14 to a battery casing 17 at the bottom of the handle 15. Air inlet passages 18 are located through the handle 15 and lead directly into passage 16. An opening 19 is also located in the bottom of the handle to allow air flow from inside the battery casing to the passage 16. The battery casing accommodates a power tool battery which may be in the form of a number of battery cells.

A trigger switch 20 is located under housing 11 in a front upper section of handle 15. Speed control circuitry 21 is connected behind the trigger inside the handle and is provided with a heat sink 22 to assist with dissipation of heat. The speed control circuitry 21 represents a power tool component 21 which generates heat. At least the fins of the heat sink 22 are located within the cooling passage 16 to dissipate the heat from the speed control circuitry.

Figure 2:
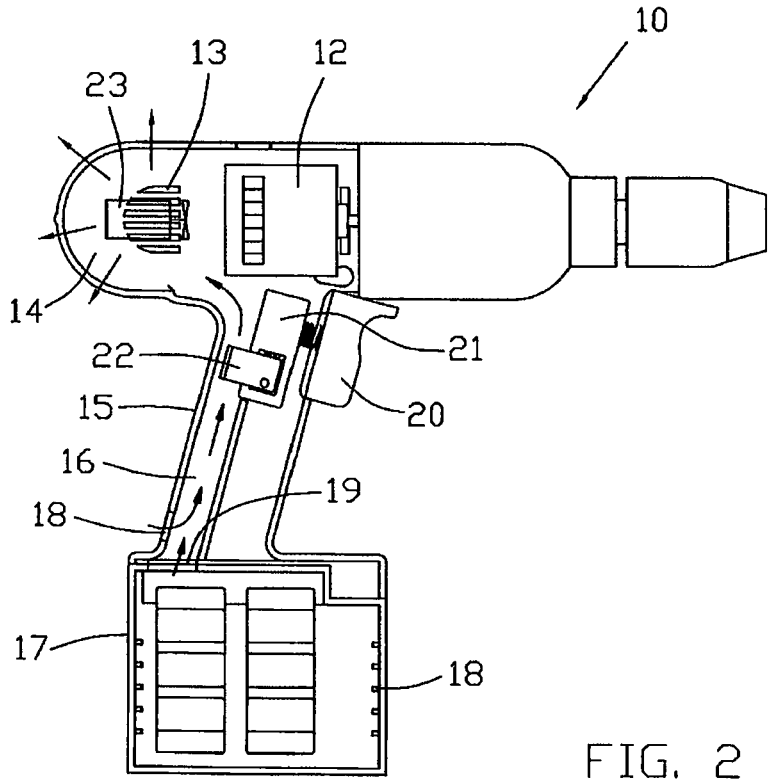
FIG. 2 shows a cordless power tool with a cooling system according to a second embodiment of the invention.

In accordance with the embodiment shown in FIG. 1, it is preferred that air is sucked in through the inlets 18 and opening 19 up through passage 16 and out through the slots 13 as a result of suction induced by the power tool motor. As shown in FIG. 2 this may be enhanced by providing a flow induction device 23 in the form of a separate fan 23 located behind the motor 12.

Figure 3:
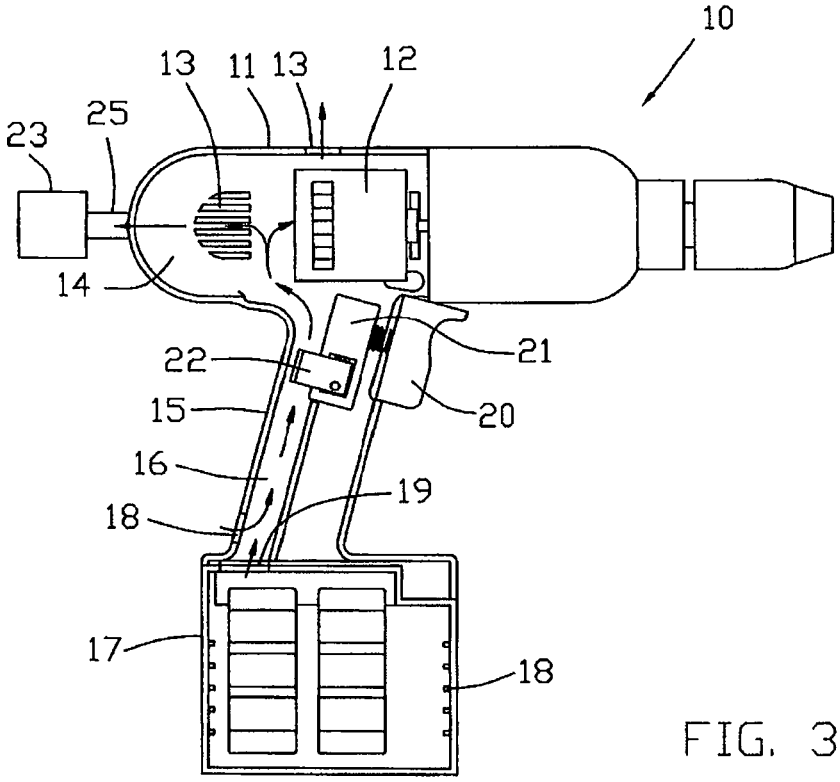
FIG. 3 shows a cordless power tool with a cooling system according to a third embodiment of the present invention.

As shown in FIG. 3, in accordance with the third embodiment of the invention, an external flow induction device 23 may be located outside the rear end of the housing 11. The external flow induction device 23 may be a suction device such as a fan, especially of the blower or impeller type and may be connected to the outer surface of the housing 11, with an opening 25 allowing air to be drawn from chamber 14. The external flow induction device 23 may be powered by an external, dedicated source of power or it may be electrically connected to the power tool battery.

Figure 4:
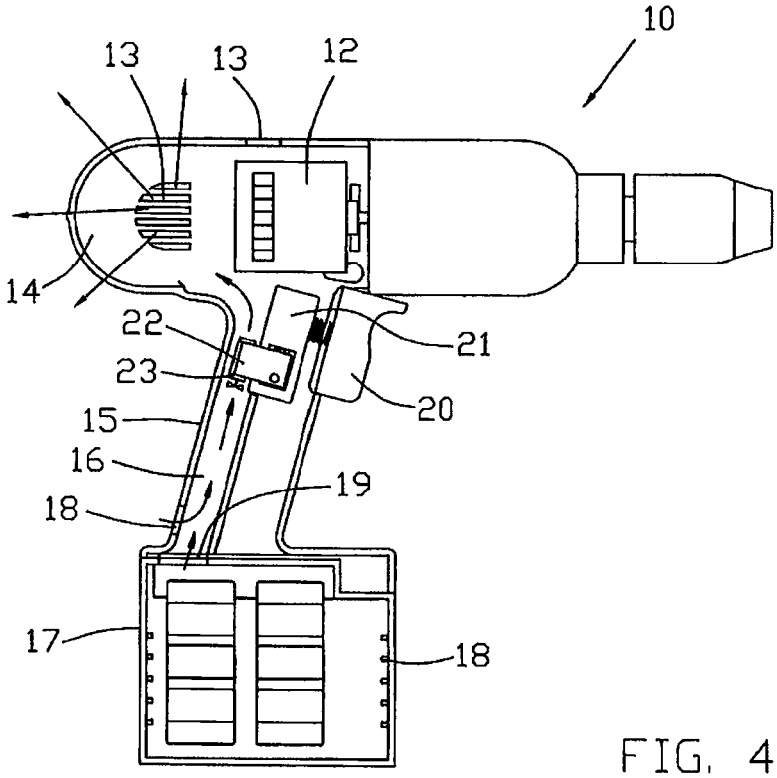
FIG. 4 shows a cordless power tool with a cooling system according to a fourth embodiment of the present invention.

According to a fourth embodiment of the present invention shown in FIG. 4, the passage 16 may be provided with a fan 23 which is attached to the heat sink 22. The fan 23 in operation then sucks air through the inlets 18 and opening 19 for expulsion through the slots 13 with an excellent flow of cooling air passing over the heat sink 22.

Figure 5:
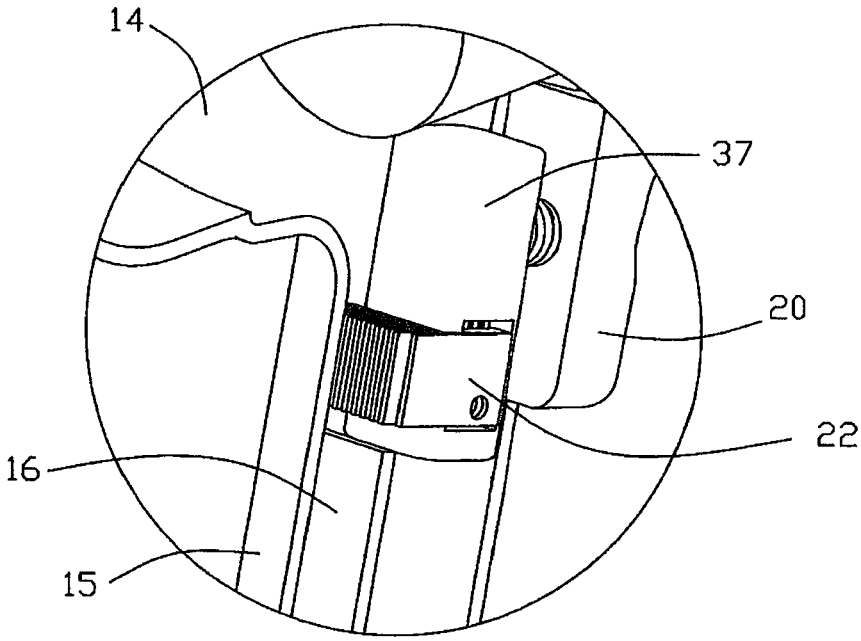
FIG. 5 is an enlarged view of a portion of the power tool showing details of a heat sink.

FIG. 5 shows an enlarged view of the heat sink 22 and how this is located behind speed control circuitry 21 and trigger switch 20. The speed control circuitry 21 preferably includes one or more MOSFET devices associated with the heat sink 22. It is preferred that the speed control circuitry 21 is located in a housing 37 with the trigger switch 20 attached to it. The heat sink 22 preferably incorporates cooling fins.

Figure 6:
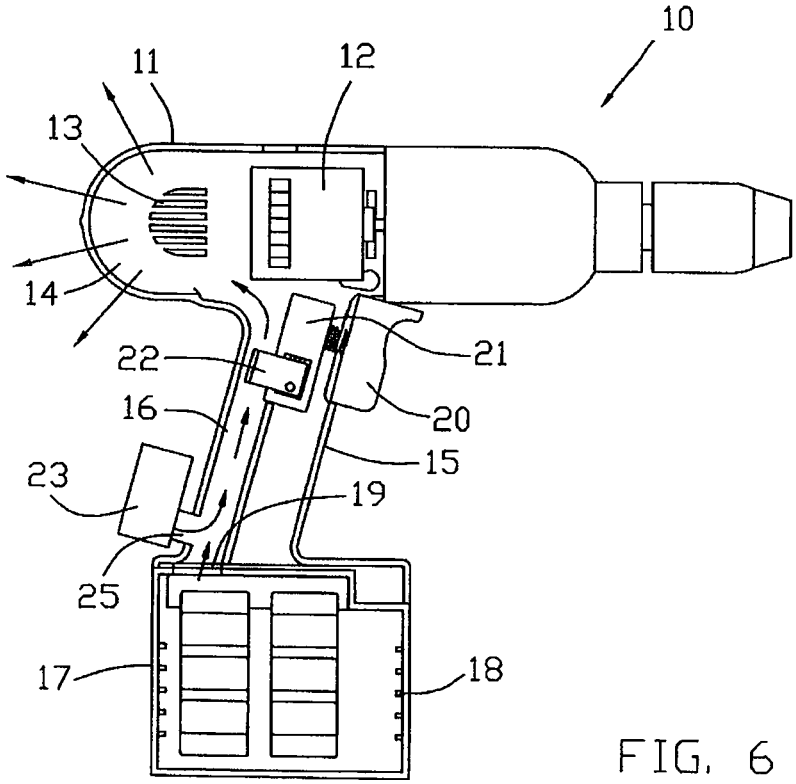
FIG. 6 shows a cordless power tool with a cooling system according to a fifth embodiment of the present invention.

A fifth embodiment of the present invention as shown in FIG. 6 consists of an external flow induction device 23 in the form of a power source and blower device located behind a lower end of the handle 15 with a connecting opening 25 to allow air to be blown through passage 16. This air then passes out through slots 13.

Figure 7:
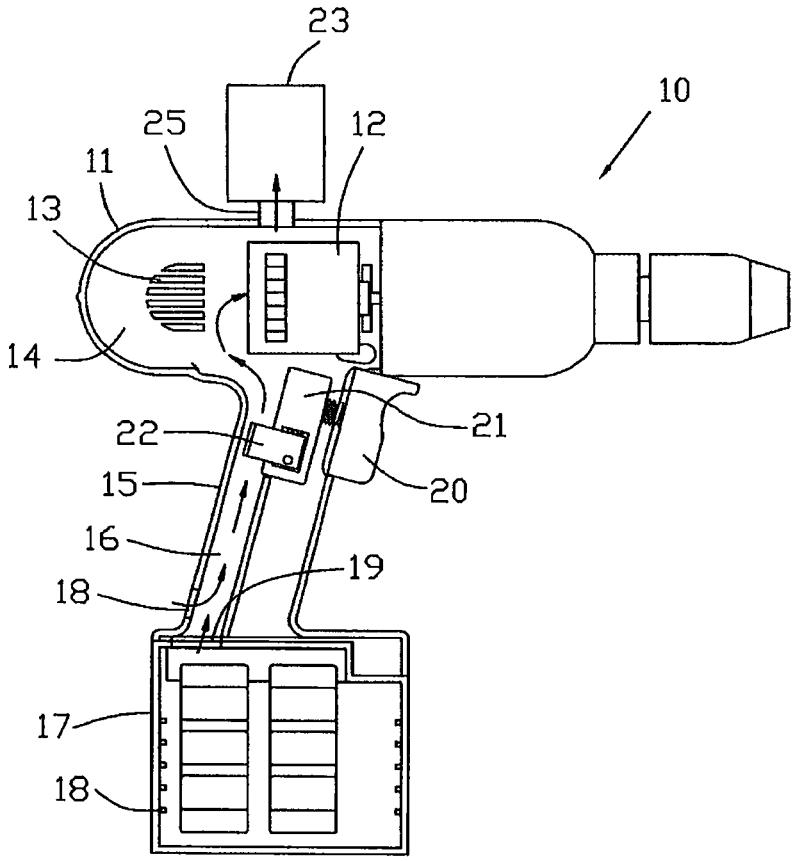
FIG. 7 shows a cordless power tool with a cooling system according to a sixth embodiment of the present invention.

According to a sixth embodiment of the invention, as shown in FIG. 7, an external flow induction device 23 is attached to the top of the housing 11 above the rear end of motor 12 and has an opening 25 to allow air to be drawn there through. When the induction device is operated air is sucked up through the inlets 18 and opening 19 out through opening 25. Alternatively, the external flow induction device could be associated with the slots 13 to induce air to flow through slots 13.

In summary in the third embodiment of the invention an external flow induction device (fan) may be located outside the housing 11 to draw air up through passage 16 and out through opening 25. Alternatively, an external blower (fan) may be attached at the lower end of the handle 15 to blow air through passage 16 and out through slots 13.

Figure 8:
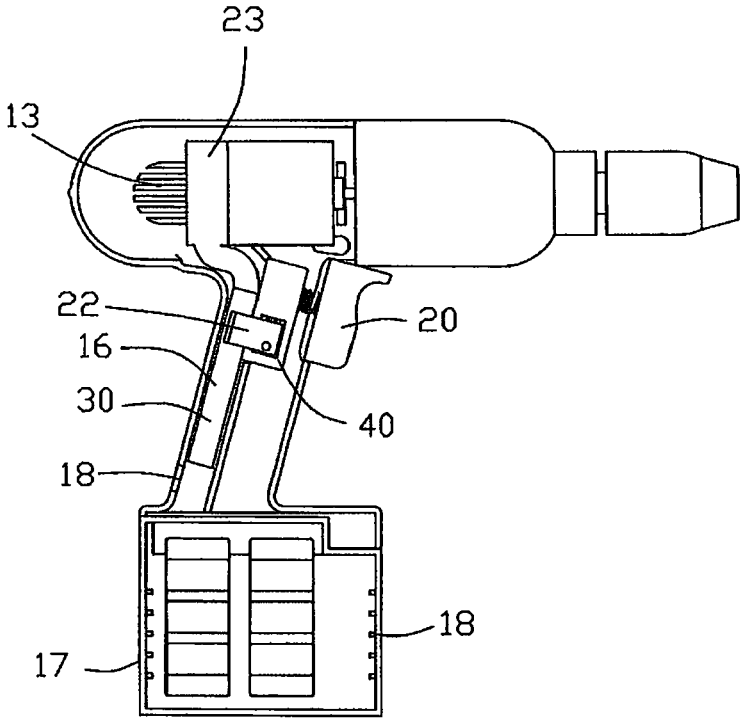
FIG. 8 shows a cordless power tool with a cooling system according to a seventh embodiment of the present invention.

According to a seventh embodiment of the invention, as shown in FIG. 8, a cooling conduit in the form of a tube 30 is located in passage 16 and this tube extends at its bottom end from battery casing 17 at its top end to the slots 13. Heat sink 22 is connected at its rear end directly to the external surface of tube 30.

It is noted that inlet passages 18 are located through the handle 15 and through the tube 30.

Figure 10:
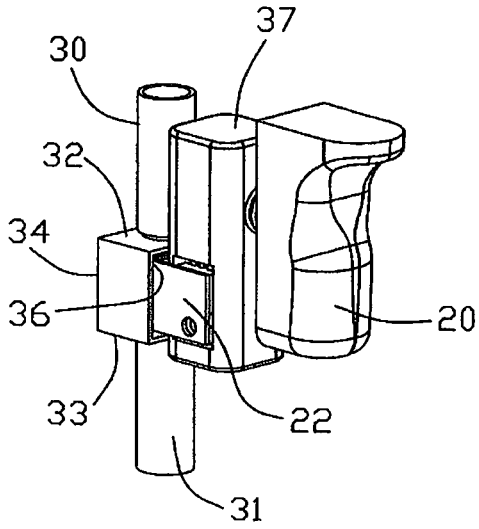
FIG. 10 shows an angled view of a variation of the cooling system according to the seventh embodiment of the present invention.

FIG. 10 shows a variation of the embodiment of the invention shown in FIG. 8. In this embodiment, the cooling conduit or tube has upper and lower parts 30, 31, which are connected to respective upper and lower openings (not shown) of upper and lower walls 32, 33 of a rectangular heat transfer box 34. The heat sink 22 has parallel fins extending in through an open side face 36 of the box 34 and is connected directly to the speed control circuitry located in housing 37. The fins (not shown) of the heat sink 22 extend across the hollow interior of the box 34 and are aligned with the direction of flow through the box 34 from lower tube part 31 to upper tube part 30. The tube is optionally of a rubber material.

It is preferred that the tubes parts 30 and 31 are fixed to respective hollow spigots forming the openings in the upper and lower walls 32, 33.

The box 34 provided in the above variation allows a simple method for configuring the heat sink 22 and tube 30 so that a cooling system can be incorporated into the power tool.

In the variation described above the box 34 may be configured so that once the fins of the heat sink 22 are located inside it the box is sealed with a sealant or equivalent to ensure fluid passing through the tube 30 does not escape from the box 34. However, this is not essential and some air leakage may provide an advantage in some situations.

According to an alternative embodiment of the invention the box 34 is not sealed and the fins of the heat sink 22 are located partially or fully inside the box 34. The box 34 may have an open back face as well as an open front face.

Figure 9:
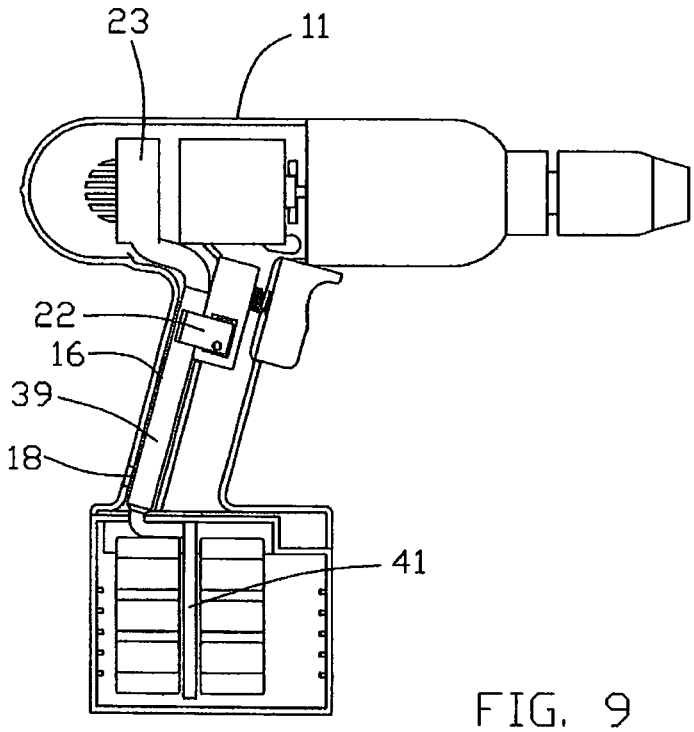
FIG. 9 shows a cordless power tool with a cooling system according to an eighth embodiment of the present invention.

According to an eighth embodiment of the present invention as shown in FIG. 9, the cooling conduit shown in FIG. 8 as tube 30, is replaced by a heat pipe 39. As with the tube 30, the heat sink 22 is attached at its rear end to the outer surface of the heat pipe and hence allows heat transfer to occur more easily by conduction. Inlet passages 18 are also provided through the handle and heat pipe in a similar fashion to that described in relation to the rubber tube embodiment.

The heat pipe shown in FIG. 9 may be solid so as to provide heat conduction, or alternatively may be hollow containing a substance which undergoes a phase change to transfer heat from one area to another. In such an embodiment the heat sink would be connected directly to the heat tube and cooling would be achieved by heat conduction from the heat sink to the heat tube and from the heat tube through radiation to the surrounding environment. Accordingly additional ventilation may be provided to move fluid such as air over the heat pipe.

According to one embodiment of the invention, the heat pipe 39 is cooled at one end by blowing air over it or sucking air from the immediate vicinity. In such an embodiment it would be preferred that this occurs within the chamber 14 of the motor housing 11.

In FIGS. 8 and 9, the cooling passage 16 is connected to a flow induction device 23 in the form of a vacuum device such as a fan or blower which creates a vacuum or area of low air pressure to draw air through the cooling passage 16. In FIG. 8, the vacuum device 23 is located in the chamber 14 adjacent to or mounted on the end of the tool motor 12 so as to draw cooling air through the motor as well as the cooling passage 16, eliminating the need for or assisting a cooling fan fitted to the tool motor. In FIG. 9, the vacuum device 23 is located within chamber 14 but spaced from the tool motor 12. The vacuum devices may be driven by the tool motor i.e. by being attached to the motor shaft. Alternatively, it may be self powered or self driven, eg by a separate power supply such as a dedicated battery or other energy source or by connection to the power tool battery.

It should be noted that although embodiments have been described in which cooling has been achieved utilising fans or impellers, any device which is able to initiate fluid flow is also encompassed by the invention. For example this includes blowing and sucking devices such as those that include moving diaphragms or bellows.

According to any one of the previously disclosed embodiments, air movement is achieved utilising one or more air pumps.

According to a further embodiment of the present invention transfer of heat from within the power tool is enhanced by providing a heat transfer means through the battery casing 17. As shown in FIG. 9 the heat pipe 39 may extend through the battery casing 17 and be connected to one or more metal plates or heat sinks 41 of the battery.

In addition to the above it is noted that any device utilised for initiating flow of fluid within the cooling system may be powered by its own power supply or from the power supply of the power tool. Other options also include utilising the power of the power tool motor shaft, compressed air or any other driving means.

In addition to the above it is noted that additional outlets may be provided in housing 11 to provide additional avenues for exit of heated air.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claim is:

1. A power tool having a cooling system, comprising:

a motor housing having a main chamber, a tool motor accommodated within the main chamber, a handle for holding the power tool, the handle having a dedicated cooling passage separate from a remainder of the handle for the transfer of cooling fluid, an inlet leading to the cooling passage and an outlet leading away from the cooling passage, and a control device for controlling operation of the tool motor, which generates heat, disposed inside the handle, in thermal contact with the cooling passage between the inlet and the outlet, wherein the cooling passage comprises a cooling conduit of high heat transfer material and wherein a heat sink of the power tool component is directly attached to the cooling conduit.

2. A power tool having a cooling system, comprising:

a motor housing having a main chamber, a tool motor accommodated within the main chamber, a handle for holding the power tool, the handle having a dedicated cooling passage separate from a remainder of the handle for the transfer of cooling fluid, an inlet leading to the cooling passage and an outlet leading away from the cooling passage, and a control device for controlling operation of the tool motor, which generates heat, disposed inside the handle, in thermal contact with the cooling passage between the inlet and the outlet.

3. The power tool of claim 2, including a flow induction device for inducing flow of cooling fluid from the inlet to the outlet.

4. The power tool of claim 3, wherein the flow induction device is located at least partially in the main chamber of the cooling passage.

5. The power tool of claim 3, wherein the flow induction device comprises one or more fans.

6. The power tool of claim 3, wherein the flow induction device is a fan driven by the tool motor.

7. The power tool of claim 3 , wherein the control device includes a speed control circuitry.

8. The power tool of claim 7, further comprising a heat sink, for the speed control circuitry, located at least partially in the cooling passage.

9. The power tool of claim 8, wherein the flow induction device is a fan mounted on the heat sink.

10. The power tool of claim 2, further comprising a battery casing having one or more of said inlets and accommodating a number of batteries, wherein the handle extends between the main chamber and the battery casing.

11. The power tool of claim 2, wherein a heat pipe is disposed in the cooling passage, the heat pipe being in direct contact with a heat sink of the control device.

12. The power tool of claim 2, wherein the cooling passage comprises a rubber tube and further includes a heat transfer box connected to the rubber tube and at least partially housing a cooling portion of the control device.

13. The power tool of claim 12, wherein the cooling portion of the control device comprises fins of a heat sink.

14. The power tool of claim 2, wherein the control device includes a switch.

15. A power tool having a cooling system, comprising:

a motor housing having a main chamber, a tool motor accommodated within the main chamber, a handle for holding the power tool, a heat pipe accommodated inside the handle, and separate from a remainder of the handle a control device for controlling operation of the tool motor which generates heat, disposed inside the handle, wherein the control device is in thermal contact with the heat pipe.

16. The power tool of claim 15, wherein the heat pipe is cooled by a flow of cooling air within the main chamber.

17. The power tool of claim 15, wherein the heat pipe makes thermal contact with a heat sink of a battery attached to the handle.

* * * * *